US008276657B2

(12) United States Patent
Ives et al.

(10) Patent No.: US 8,276,657 B2
(45) Date of Patent: Oct. 2, 2012

(54) WELL FLUID SAMPLING SYSTEM FOR USE IN HEAVY OIL ENVIRONMENTS

(75) Inventors: Sebastien Ives, Pearland, TX (US); Stephane Metayer, Abbeville (FR); Pierre-Yves Corre, Eu (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 340 days.

(21) Appl. No.: 12/775,738

(22) Filed: May 7, 2010

(65) Prior Publication Data

US 2011/0272150 A1 Nov. 10, 2011

(51) Int. Cl.
*E21B 36/04* (2006.01)
*E21B 33/12* (2006.01)
*E21B 49/08* (2006.01)

(52) U.S. Cl. ..... 166/60; 166/264; 166/133; 166/302; 392/306

(58) Field of Classification Search ..... 166/60, 166/65.1, 133, 179, 264, 302; 392/301, 306
See application file for complete search history.

(56) References Cited

U.S. PATENT DOCUMENTS

| | | | | |
|---|---|---|---|---|
| 4,547,080 | A * | 10/1985 | Dunn et al. | 374/135 |
| 6,353,706 | B1 * | 3/2002 | Bridges | 392/306 |
| 2005/0028974 | A1 * | 2/2005 | Moody | 166/264 |
| 2007/0215348 | A1 * | 9/2007 | Corre et al. | 166/264 |
| 2008/0296017 | A1 | 12/2008 | Sonne et al. | |
| 2009/0159278 | A1 | 6/2009 | Corre et al. | |
| 2009/0211756 | A1 | 8/2009 | Goodwin et al. | |

FOREIGN PATENT DOCUMENTS

WO 2010032152 A1 3/2010

OTHER PUBLICATIONS

International Search Report and Written Opinion dated Nov. 21, 2011 for corresponding PCT Application No. PCT/US2011/035094 filed May 4, 2011.

* cited by examiner

*Primary Examiner* — Kenneth L Thompson
(74) *Attorney, Agent, or Firm* — John Vereb

(57) ABSTRACT

A technique involves sampling fluids in a well environment. An expandable packer is constructed with an outer seal layer. At least one sample drain is positioned through the outer seal layer, and a heater element is deployed in the at least one sample drain. In one embodiment, the heater element is deployed proximate a radially outlying surface of the expandable packer. Additionally, a temperature sensor may be positioned proximate the at least one sample drain to monitor temperature in the environment heated by the heater element.

24 Claims, 5 Drawing Sheets

WELL FLUID SAMPLING SYSTEM FOR USE IN HEAVY OIL ENVIRONMENTS

BACKGROUND

The statements in this section merely provide background information related to the present disclosure and may not constitute prior art. Many types of packers are used in wellbores to isolate specific wellbore regions. A packer is delivered downhole on a conveyance and expanded against the surrounding wellbore wall to isolate a region of the wellbore. Often, two or more packers can be used to isolate one or more regions in a variety of well related applications, including production applications, service applications and testing applications. In some applications, packers are employed to isolate a specific region of the wellbore for collection of well fluid samples. However, many existing sampling techniques are difficult to use when sampling heavy oils or other viscous fluids.

SUMMARY

In general, the present disclosure provides a system and method for sampling fluids in a well environment. An expandable packer is constructed with an outer seal layer. At least one sample drain is positioned through the outer seal layer, and a heater element is deployed in the at least one sample drain. In one embodiment, the heater element is deployed proximate a radially outlying surface of the expandable packer. Additionally, a temperature sensor may be positioned proximate the at least one sample drain to monitor temperature in the environment heated by the heater element.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present disclosure generally relates to a system and method for collecting fluid samples through a drain located in a packer. A fluid sample is collected from a surrounding formation through an outer layer of the packer and conveyed to a desired collection location. The packer also comprises a heater system which cooperates with the drain to lower the viscosity of heavy oils and/or other materials to facilitate collection of samples for analysis.

The packer may be expanded across an expansion zone along the formation to facilitate heating and sample collection of the subject fluids. The fluid sample is collected and then directed along flow lines, e.g. along flow tubes, having sufficient inner diameter to allow inflow of sample material from sample collection operations in a variety of environments. Formation fluid samples can be collected through one or more drains. For example, separate drains may be disposed at distinct locations around the packer to establish collection intervals or zones that enable focused sampling at a plurality of collecting regions or intervals along the expansion zone. Separate flowlines can be connected to different drains to enable the collection of unique formation fluid samples from the different regions or intervals.

The packer incorporates a heater system to facilitate the collection of sample materials having relatively high viscosities until heated. Without heating, the high viscosity of the material can prevent collection of suitable samples. The heater system is operated to reduce the viscosity of heavy oils or other substances by providing controlled heat in the region to be sampled. In some embodiments, the heater system generally comprises one or more heating elements positioned in one or more corresponding drains of the packer. The heating elements may be powered via an electric power line routed to the packer, and heat may be generated by the heating elements over predetermined periods of time to sufficiently lower the viscosity of the desired material. Additionally, one or more temperature sensors may be placed proximate the heating elements to monitor temperature in the region. Monitoring temperature enables better control over the sampling and also guards against creating excessive heat along an external seal surface of the packer.

Figure 1:
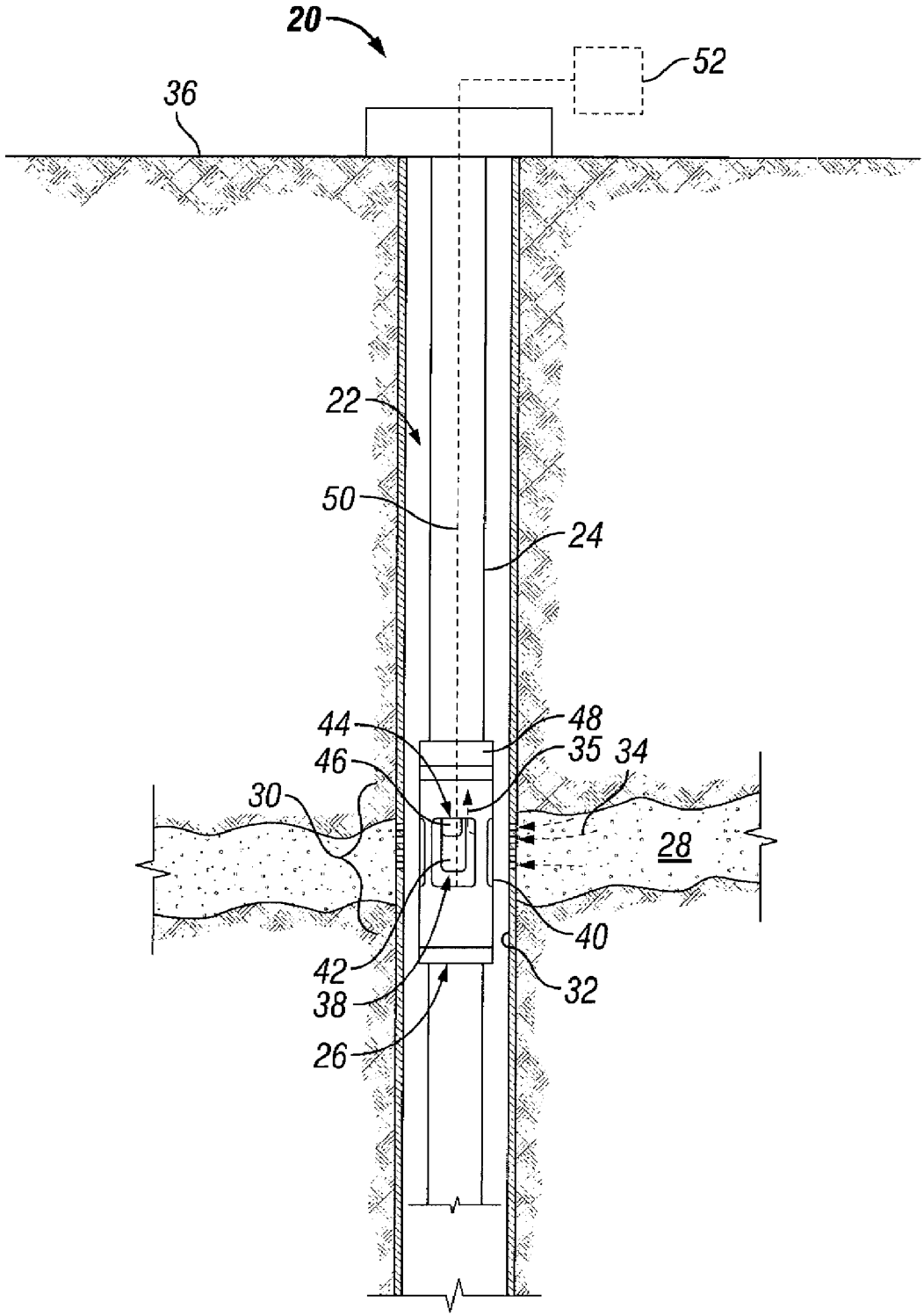
FIG. 1 is a schematic front elevation view of an embodiment of a well system having a packer with a heater system to facilitate collection of fluid samples.

Referring generally to FIG. 1, one embodiment of a well system 20 is illustrated as deployed in a wellbore 22. The well system 20 comprises a conveyance 24 employed to deliver at least one packer 26 downhole. In many applications, packer 26 is deployed by conveyance 24 in the form of a wireline, but conveyance 24 may have other forms, including tubing strings, for other applications. In the embodiment illustrated, packer 26 is an expandable packer used to collect formation fluid samples from a surrounding formation 28. The packer 26 is selectively expanded in a radially outward direction to seal across an expansion zone 30 with a surrounding wellbore wall 32, such as a surrounding casing or open wellbore wall. When packer 26 is expanded to seal against wellbore wall 32, formation fluids can be flowed into packer 26, as indicated by arrows 34. The formation fluids are then directed to a flow line, as represented by arrow 35, and produced to a collection receptacle or other collection location, such as a location at a well site surface 36.

A heater system 38 is incorporated into the expandable packer 26 to enable selective lowering of the viscosity of a substance, e.g. oil, to be sampled through packer 26. In this embodiment, packer 26 comprises a plurality of drains 40 through which the desired sample fluids are drawn. The heater system 38 comprises one or more heater elements 42 which are located in one or more of the sample drains 40 to provide sufficient heat to adequately lower the viscosity of fluids along the surrounding formation. Once the viscosity is sufficiently lower, the fluids may be drawn from formation 28 into packer 26 through one or more of the sample drains 40. A sensor system 44 is employed to monitor the sampling process. In one embodiment, sensor system 44 comprises a plurality of temperature sensors 46 which may be positioned in the sample drains 40 with a corresponding heater element 42 or in another suitable location in the region being heated. One or more sensors 46 may be placed proximate to an external surface of the packer in the region being heated to prevent creation of excess heat which could burn the oil sample or cause other damage. In one procedural example, the packer 26 is deployed into wellbore 22 and expanded against the surrounding wellbore wall 32 to seal across the expansion zone 30. A fluid sample is then obtained through at least one sample drain 40.

Electrical power may be supplied to heater system 38 via a downhole power supply module 48, e.g. a battery or power converter. The power supply module 48 either has its own power source or is supplied with electrical power through a line 50, such as a cable routed downhole to the heater system 38 for transfer of power signals and/or data signals. In some applications, power supply 48 may comprise transformers or other devices to convert the electrical signal supplied from another location through cable 50. For example, heater system 38 and heater elements 42 may be designed to operate when powered with an electrical current, such as a direct current, e.g. 50 volt direct current. In one embodiment, four drains 40 each contained one of the heater elements 42, thereby providing four resistances for heating the region surrounding drains 40. If each heater element/resistance 42 is designed so the minimum power to be dissipated by each resistance is 200 watts, a total of at least 800 watts may be dissipated to heat fluids in the surrounding formation 28.

The sensor system 44 utilizes temperature sensor 46 to monitor temperature in a region around each drain 40. For example, the temperature sensor or sensors 46 may be used to monitor an outer surface temperature of packer 26. By combining sensor system 44 and heater system 38, the temperature measured by temperature sensor 46 may be used to control the outer surface temperature of packer 26 through regulation of the power supplied to heater elements 42 of heater system 38. For example, if the outer surface temperature of packer 26 should not exceed 200° C., then the power supplied to heater elements 42 may be regulated to sufficiently lower the viscosity of the surrounding fluids being sampled while preventing undue sample heating/packer damage by limiting the heat output of heater system 38. The power provided to heater system 38, based on data from sensor system 44, may be controlled by a control system 52, e.g. a processor-based control system, located at a suitable location, such as a surface location or a downhole location. Additionally, the overall packer 26, along with its heater system 38 and sensor system 44, is designed to withstand the hydrostatic pressure experienced in a variety of wellbore environments in which hydrostatic pressure can reach 5000 psi or more.

Controlled heating of the surrounding formation 28 during a defined period of time facilitates collection of desired samples from these downhole environments. Depending on the environment and type of fluid to be sampled, thermal calculations can be performed to determine the desired heat and heating time required to make the oil or other sample substance smoother for sample collection. In many applications, the system may be designed to run for specific periods of time, e.g. sequential time periods of 10 hours.

Figure 2:
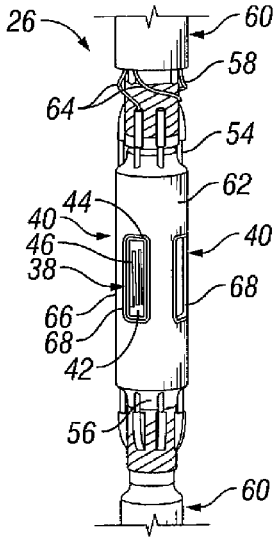
FIG. 2 is a front view of one example of the packer illustrated in FIG. 1.

Referring generally to FIG. 2, one embodiment of expandable packer 26 is illustrated. In this embodiment, packer 26 comprises an outer structural layer 54 which is expandable in a wellbore to form a seal with surrounding wellbore wall 32 across expansion zone 30. By way of example, the packer 26 may further comprise an inner, inflatable bladder 56 disposed within an interior of outer structural layer 54. The inflatable bladder 56 can be formed in several configurations and with a variety of materials, such as a rubber layer having internal cables. In one example, the inner bladder 56 is selectively expanded by fluid delivered via an inner mandrel 58. Furthermore, packer 26 comprises a pair of mechanical fittings 60 which are mounted around inner mandrel 58 and engaged with axial ends of outer structural layer 54. It should be noted that packer 26 may utilize other expansion mechanisms in combination with the heater system 38 and sensor system 44.

In the embodiment illustrated, outer structural layer 54 is coupled with the one or more drains 40 through which formation fluid is collected when structural layer 54 is expanded to seal packer 26 against surrounding wellbore wall 32. Drains 40 may be embedded radially into a sealing element or seal layer 62 which surrounds outer structural layer 54. By way of example, sealing layer 62 may be cylindrical and formed of an elastomeric material selected for hydrocarbon based applications, such as nitrile rubber (NBR), hydrogenated nitrile butadiene rubber (HNBR), and fluorocarbon rubber (FKM).

A plurality of tubular members or tubes 64 may be operatively coupled with drains 40 for directing the collected formation fluid sample in an axial direction through one or both of the mechanical fittings 60. In some embodiments, tubes 64 may be at least partially embedded in the material of sealing element 62 and thus move radially outward and radially inward during expansion and contraction of structural layer 54.

Figure 3:
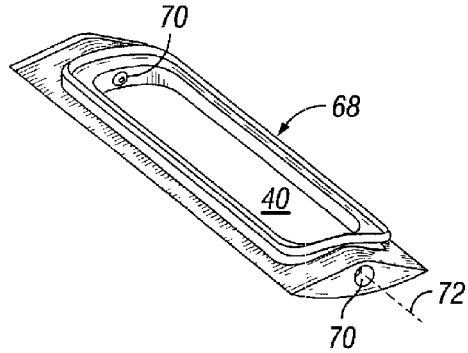
FIG. 3 is an orthogonal view of an embodiment of a support positioned around a sample drain in the packer.

In the embodiment illustrated, heater elements 42 of heating system 38 are generally disposed along an outer surface 66 of packer 26, e.g. along the outer surface of seal layer 62. The temperature sensor 46 also is disposed in this region, e.g. within the same drain 40 to accurately control temperature along the surface 66 of packer 26. In many cases, this surface temperature is controlled so that it does not exceed 200° C., thus avoiding burning the oil or other material being sampled. In the specific example illustrated, packer 26 comprises four drains 40 and each drain contains one of the heater elements 42. The drains 40 are outlined by supports 68, e.g. metallic supports, as further illustrated in FIG. 3. For example, each support 68 may comprise a rectangular metal frame having one or more openings 70 designed for connection with the corresponding tube 64 and/or for receiving a power supply wire 72 therethrough. The power supply wire 72 is coupled with the corresponding heater element 42 located within the drain 40.

Figure 4:
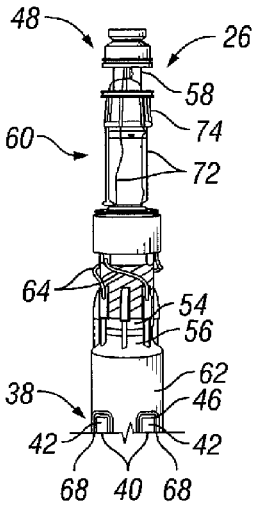
FIG. 4 is a front view of a portion of the packer illustrated in FIG. 2.

As further illustrated in FIG. 4, the power supply wires 72 and other communication lines, e.g. communication lines coupled with temperature sensor 46, may be routed through one or more feed throughs 74. The feed throughs 74 facilitate routing of various power supply lines and other communication lines through mechanical fittings 60 and or other components along the axial end of packer 26. By way of example, power supply wires 72 may be routed through feed throughs 74 for coupling with the power supply module 48, which may be in the form of a cartridge tool, a downhole battery, a transformer coupled to a power cable, or another suitable type of power supply module for providing or relaying electrical power.

Figure 5:
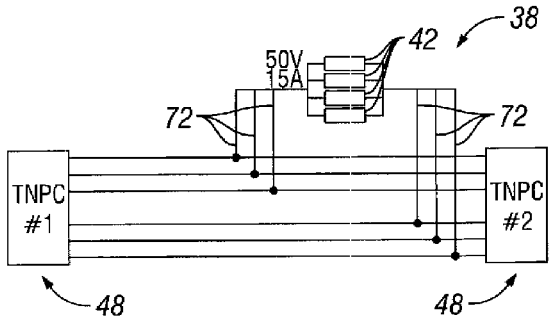
FIG. 5 is a schematic illustration of an embodiment of an electrical circuit which can be used to provide power to the heater system.

Referring generally to FIG. 5, a wiring diagram is provided to illustrate one example of circuitry which may be used to provide power to four heater elements 42. It should be noted, however, that a variety of circuits may be designed to supply power to one or more heater elements 42 having a variety of power ratings. In the example illustrated, power supply module 48 comprises a pair of components for supplying the desired power, e.g. 800 watts, to four heater elements 42. In this particular example, three power supply lines 72 are available for connecting the heater system 38 and for delivering the desired power to create heat. The circuit comprises a parallel wiring layout so in case of failure of one of the heating resistances 42, the other heating elements are still able to provide heat. Heating elements 42 may be designed with specific resistances to create a desired heating of the surrounding region. For example, the heating elements 42 may be designed to consume 16 amperes of current at 50 volts to achieve the desired 800 watts power for dissipation as heat. However, the circuit also may be designed to accommodate other numbers of heating elements and other current/voltage/power values.

Figure 6:
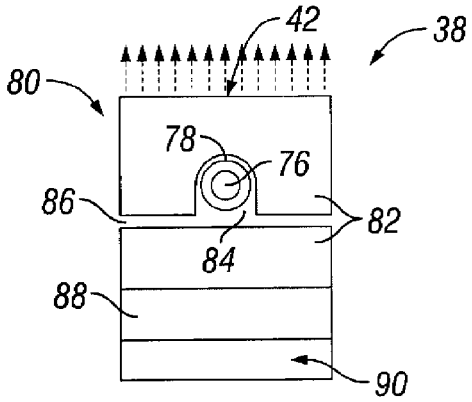
FIG. 6 is an illustration of an embodiment of a heater system for use in a sample collection packer.

Referring generally to FIG. 6, one example of heater system 38 is illustrated. The embodiment of FIG. 6 illustrates only a single heater element 42, although the heater system 38 may comprise a plurality of heater elements 42 for placement in a plurality of corresponding drains 40, as illustrated in FIG. 2. In the embodiment illustrated, heater element 42 comprises a resistance in the form of a resistive element 76, e.g. a resistive wire. The resistive wire 76 may be an insulated resistive wire having a layer of insulation 78 surrounding the wire 76. By way of example, the resistive wire 76 may comprise RW 80 nickel-chrome (Nichrome 80) wire, and the insulation layer 78 may comprise an insulation material, such as, but not limited to, perfluoroalkoxy (PFA) polytetrafluoroethylene (PTFE), polyetheretherketone (PEEK), or similarly commercially available material such as Teflon™ insulation. However, other resistive materials and insulation materials may be used depending on the specific application, environment, and desired heat generation.

The resistive wire 76 and its insulation layer 78 are positioned in a heat conducting block 80 which may be formed of a material having high thermal conductivity properties, such as a metal material. For example, the heat conducting block 80 may be formed with a pair of metal plates 82 which trap the resistive wire 76 and insulation layer 78 therebetween. In the example illustrated, one or both of the metal plates 82 comprises a recessed portion or portions 84 which may be machined or otherwise formed into the metal plates 82 to receive resistive wire 76 and the surrounding insulation layer 78. The metal plates 82 may be formed of copper or another suitable conductive material. In a non-limiting example, a composite made with pitch-based carbon fibers may exhibit high thermal conductivity, and may be suitable for use as a heat conducting block 80 for receiving the resistive wire 76 and insulation layer 78.

Resistive wire 76 and insulation layer 78 can be secured in place with a potting material 86, such as, but not limited to, an epoxy resin, a cyanate ester, a bismaleimide (BMI) resin a bismaleimide triazine (BT) resin or the like, injected into recess 84 to fill empty voids/cavities. As further illustrated in FIG. 6, a heat insulation plate 88 may be positioned adjacent one of the metal plates 82. Additionally, a support 90, e.g. a metal support, is positioned against heat insulation plate 88 on a side opposite the metal plate 82. The support 90 is useful for mounting the heating element 42 at a desired position within one of the drains 40. In this example, the design of heater element 42 allows the heater element to withstand substantial wellbore pressure, such as hydrostatic pressures reaching 5000 psi or more.

Depending on sampling application parameters and the desired heat output, the resistive wire/element 76 and heater element 42 may be designed in a variety of configurations. In one example described above, each heater element 42 is designed to dissipate power of approximately 200 watts with 50 volt direct current. This output can be achieved by using resistive wire 76 made of RW 80 nickel-chrome and having dimensions and characteristics of approximately: a length of 1921 mm; a wire resistance of 6.51 Ohms/mm; a wire section of 0.17 $mm^2$; a wire diameter of 0.46 mm; and a Teflon™ insulation thickness of 0.3 mm. Of course, the dimensions, characteristics, and material types may be changed to accommodate other configurations, environments and power outputs.

Figure 7:
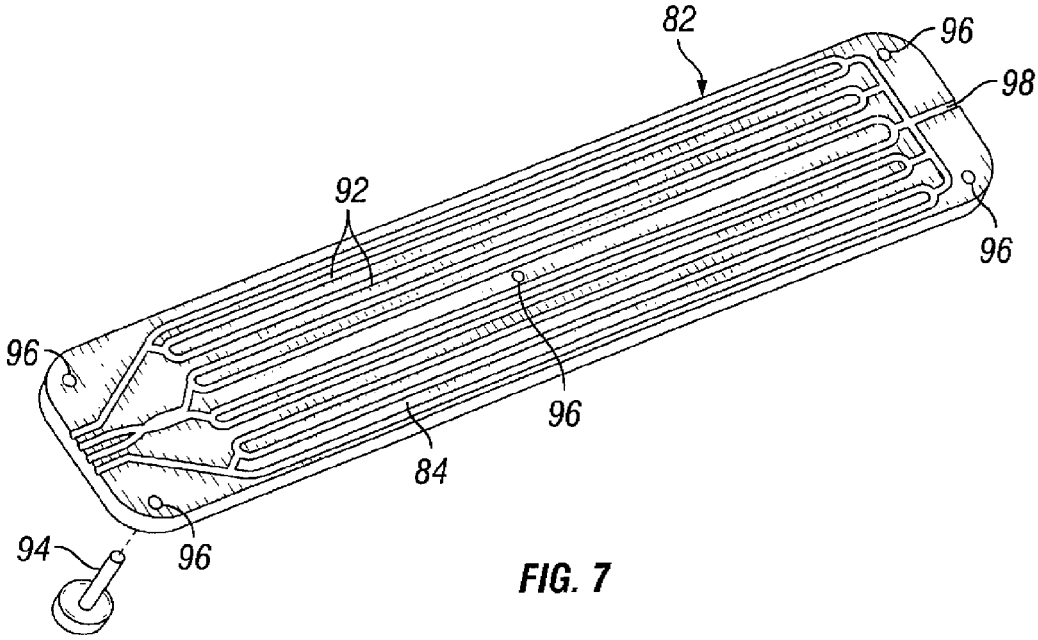
FIG. 7 is a view of one of the metal plates illustrated in FIG. 6.

Referring generally to FIG. 7, an embodiment of one of the metal plates 82 is illustrated as having the recess 84 formed by a plurality of machined grooves 92. The machined grooves 92 are sized to receive the resistive wire 76 and surrounding insulation layer 78 in a circuitous arrangement to provide the desired length of resistive wire 76. In the example illustrated, plate 82 is a bottom or support plate formed of a copper material. Once the resistive wire 76 is positioned in the machined grooves 92, the adjacent metal plates 82 are secured together to form the heat conducting block, as illustrated in FIG. 6. By way of example, the adjacent metal plates 82 may be held together by rivets 94 inserted through corresponding openings 96 in the metal plates 82.

Figure 8:
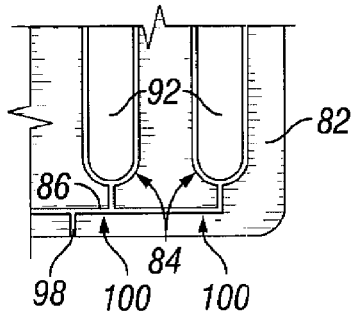
FIG. 8 is a schematic view of a portion of the metal plate illustrated in FIG. 7 to show an injection passage for injecting potting material.

With additional reference to FIG. 8, an injection passageway 98 may be machined or otherwise formed in one or more of the metal plates 82. The injection passageway 98 is connected with an injection flow network 100 which conducts the potting material 86, e.g. epoxy resin, to the machined grooves 92 when injected through passageway 98. This allows the material 86 to be distributed throughout the metal plates 82 around the resistive wire 76 and insulation layer 78. In one embodiment, silver particles are added to the epoxy resin 86 to provide better heat dissipation.

Figure 9:
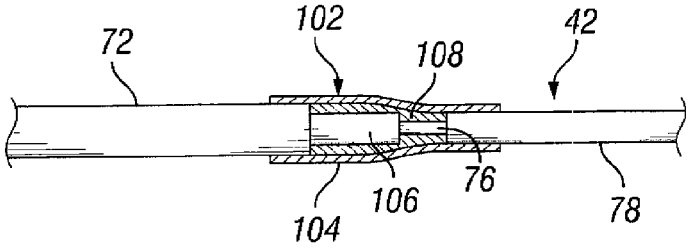
FIG. 9 is an illustration of an embodiment of a connection by which a resistive element of the heater system is coupled with a power supply wire.
Figure 10:
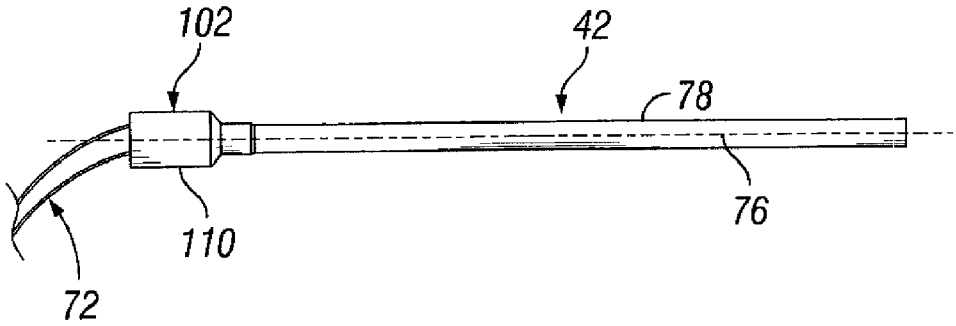
FIG. 10 is a view of an embodiment of a heater element which may be used to heat a fluid to be sampled.

The resistive wire 76 and surrounding insulation layer 78 of heating element 42 may be connected to the power supply wire 72 by a connection system 102, as illustrated in the embodiment of FIG. 9. In this example, connection system 102 comprises a cover 104 in the form of a tubular member which extends over both power supply wire 72 and the insulation layer 78. Resistive wire 76 is joined with a corresponding conductive element 106 of power supply wire 72 and surrounded with epoxy 108 or a suitable insulating material injected into the interior of cover 104.

In an alternate embodiment of the connection system 102, power supply wires 72 are coupled with the resistive wire 76 and insulation layer 78 in a casing 110, as illustrated in FIG.

Figure 11:
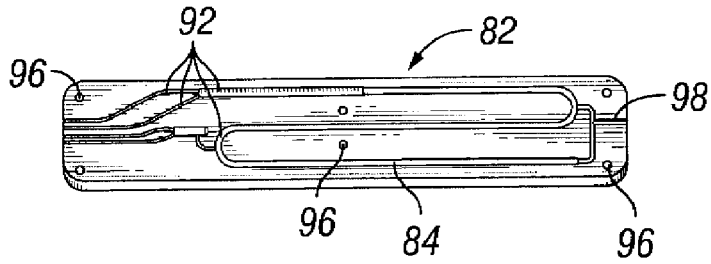
FIG. 11 is a view of an embodiment of a metal plate which has been machined to receive the heater element illustrated in FIG. 10.

10. The casing 110 is filled with silicone which is allowed to set and insulate the connection. Matching, adjacent metal plates 82 are both machined or otherwise formed with appropriate grooves 92 sized to accommodate the power supply wires 72, casing 110, and insulated resistive wire 76, as illustrated in FIG. 11. By way of example, both metal plates 82 may be formed of copper, secured together and injected with the appropriate potting material 86.

Figure 12:
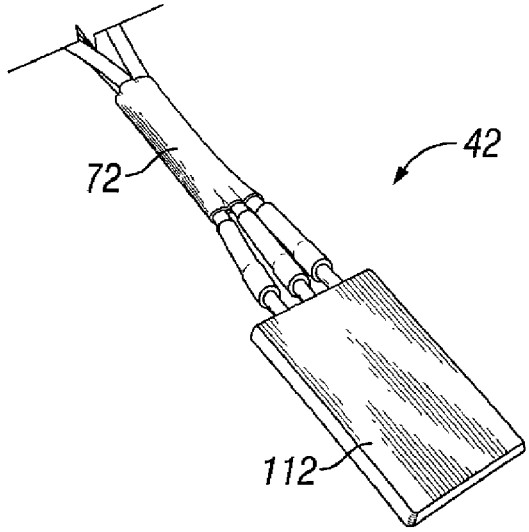
FIG. 12 is a view of an embodiment of a heater element which may be used to heat a fluid to be sampled.
Figure 13:
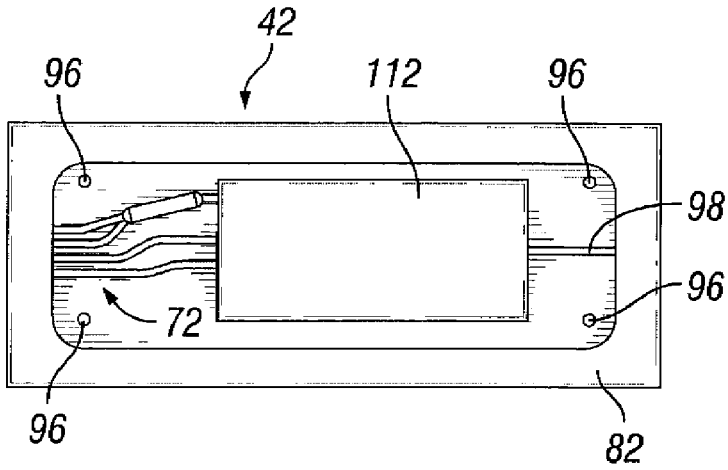
FIG. 13 is a view of a metal plate which has been machined to receive the heater element illustrated in FIG. 12.

In another alternate embodiment, each heater element 42 of heater system 38 comprises a ceramic heater 112, as illustrated in FIG. 12. The ceramic heater 112 is powered by electrical power supplied through appropriate power supply wires 72. By way of example, ceramic heater 112 is formed with a matrix of ceramic material, such as aluminum nitride ceramic powder, which can be heated to a desired temperature. As illustrated in FIG. 13, one or more of the metal plates 82 may be machined or otherwise formed to securely receive the ceramic heater 112. As with other embodiments described above, the potting material 86 may be injected through injection passageway 98 to fill empty cavities. The potting material 86 may comprise an epoxy resin with silver particles or another suitable mixture designed to provide better heat dissipation.

Figure 14:
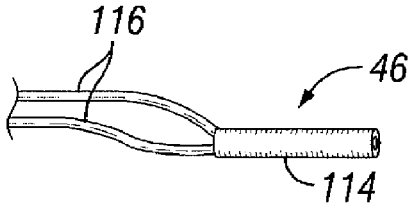
FIG. 14 is a view of an embodiment of a temperature sensor which is employed in the heater system to monitor temperature along an outer region of the packer.
Figure 15:
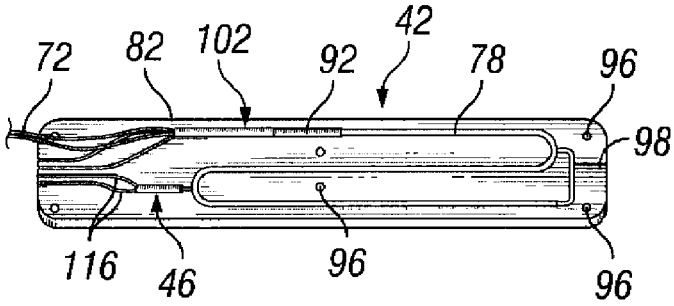
FIG. 15 is a view of an embodiment of a metal plate machined to receive both a heater element and a temperature sensor.

Referring generally to FIGS. 14 and 15, sensor system 44 may comprise a variety of sensors and sensor types. In the example illustrated, however, sensor system 44 utilizes an individual temperature sensor 46, as illustrated best in FIG. 14, in cooperation with each heater element 42. In this particular example, temperature sensor 46 comprises a sensor portion 114, such as a PT 100 temperature sensor, coupled with single-strand wire 116. This type of sensor is suitable for temperature ranges up to 250° C. and hydrostatic pressures of 5000 psi or more. However, other types and configurations of temperature sensors or other sensors may be employed in sensor system 44 according to the specifics of a given application and environment.

As illustrated best in FIG. 15, the temperature sensor 46 may be positioned in heat conducting block 80. In this example, one or both of the metal plates 82 comprises a groove 116 which may be machined or otherwise formed to receive temperature sensor 46. In this manner, the temperature sensor 46 is held proximate the heater element 42/resistive wire 76 to monitor heat output in a region proximate outer surface 66 of packer 26. In other applications, temperature sensor 46 may be mounted at other locations or in different mounting structures to monitor temperature in the desired region proximate its corresponding drain 40.

As described above, well system 20 may be constructed in a variety of configurations for use in many environments and applications. The packer 26 may be constructed from many types of materials and components for collection of formation fluid samples from one or more expansion zones. Furthermore, packer 26 may incorporate individual or plural heating elements having different arrangements of components and features depending on the specific sampling application. The heating system and temperature monitoring system may have multiple configurations formed of various types of materials and components to accommodate several types of sampling applications.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for collecting a fluid sample in a wellbore, comprising:

a packer having:

an outer structural layer;

a plurality of drains coupled to the outer structural layer;

a seal layer disposed around the outer structural layer; and a heating system having a plurality of separate heating elements positioned in the plurality of drains proximate an outer surface of the packer, the heating system further comprising a temperature sensor positioned to monitor the temperature of the outer surface.

2. The system as recited in claim 1, wherein the plurality of separate heating elements comprises four separate heating elements positioned in four corresponding drains of the plurality of drains.

3. The system as recited in claim 1, wherein the plurality of separate heating elements is powered by an electrical current.

4. The system as recited in claim 1, wherein each separate heating element of the plurality of heating elements comprises a resistive wire.

5. The system as recited in claim 1, wherein the packer further comprises a metallic support positioned around each drain, the metallic support comprising a passage through which a power supply wire extends.

6. The system as recited in claim 4, wherein the resistive wire is captured between plates having high thermal conductivity properties.

7. The system as recited in claim 4, wherein the resistive wire is captured between metal plates.

8. The system as recited in claim 7, wherein at least one of the metal plates comprises a machined recess to receive the resistive wire.

9. The system as recited in claim 7, wherein the resistive wire is covered by an electric insulation coating.

10. The system as recited in claim 9, wherein the insulation coating comprises a Teflon™ insulation.

11. The system as recited in claim 9, wherein the resistive wire is secured between the metal plates with an epoxy resin material.

12. The system as recited in claim 1, wherein the plurality of separate heating elements comprises a plurality of ceramic heaters.

13. A method of collecting a fluid sample in a wellbore, comprising:

forming an expandable packer with an outer seal layer;

positioning at least one sample drain through the outer seal layer;

locating a heater element in the at least one sample drain proximate a radially outlying surface of the expandable packer;

deploying and expanding the expandable packer in the wellbore;

obtaining at least one fluid sample from the at least one sample drain; and monitoring a temperature proximate the radially outlying surface with a temperature sensor positioned in the expandable packer.

14. The method as recited in claim 13, further comprising operating the heater element downhole to create heat and lower the viscosity of a surrounding well fluid; and taking a sample of the surrounding well fluid.

15. The method as recited in claim 13, wherein locating comprises locating a plurality of heater elements with one heater element in each of a plurality of sample drains.

16. The method as recited in claim 13, wherein monitoring comprises monitoring with a temperature sensor located in the at least one sample drain.

17. The method as recited in claim 13, further comprising forming the heater element with a resistive element between two metal plates.

18. The method as recited in claim 13, further comprising forming the heater element with a resistive element positioned in a conductive block formed of a pitch carbon fiber composite material.

19. The method as recited in claim 18, wherein securing comprises securing the resistive element in the recess with a surrounding insulation layer and an epoxy resin.

20. A system for sampling in wellbore, comprising:

an expandable packer having a seal layer, at least one sample drain disposed through the seal layer, and a heater system positioned in the at least one sample drain, the heater system comprising:

a resistive element;

a metal plate having a recess sized to receive the resistive element; and a material to secure the resistive element within the recess.

21. The system as recited in claim 20, wherein the material comprises an electrical insulation layer around the resistive element and a potting material around the electrical insulation layer.

22. The system as recited in claim 20, wherein the heater system further comprises a second metal plate to trap the resistive element in the recess.

23. The system as recited in claim 20, wherein the resistive element comprises a resistive wire.

24. The system as recited in claim 20, wherein the heater system further comprises a temperature sensor to monitor temperature of an outer layer of the expandable packer in a region proximate to the resistive element.

* * * * *